United States Patent [19]

Galloup et al.

[11] Patent Number: 4,597,419

[45] Date of Patent: Jul. 1, 1986

[54] BIT DRIVING ATTACHMENT FOR CONDUCTOR WRAPPING TOOL

[75] Inventors: Clifford L. Galloup, Reed City; Paul D. Stack, Jr., Cadillac, both of Mich.

[73] Assignee: Cooper Industries, Inc., Houston, Tex.

[21] Appl. No.: 765,297

[22] Filed: Aug. 13, 1985

[51] Int. Cl.[4] ..... B21F 15/04

[52] U.S. Cl. ..... 140/124; 242/7.17

[58] Field of Search ..... 140/122, 124; 242/7.17; 433/127, 128

[56] References Cited

U.S. PATENT DOCUMENTS 3,200,922 8/1965 Allen ..... 242/7.17

4,284,109 8/1981 Kilmer et al. ..... 140/124

*Primary Examiner*—Lowell A. Larson

*Attorney, Agent, or Firm*—Michael E. Martin; Alan R. Thiele; Eddie E. Scott

[57] ABSTRACT

A support mechanism for a rotatable conductor wrapping bit for quick detachment from a conductor wrapping tool includes a housing for the bit and for a rotatable bit driver member. Radially inwardly projecting pins are disposed on the housng and project into a bore which receives a sleeve on the motor housing having opposed "j" slots. One of the pins is radially inwardly movable into locking engagement with the bit driver member whereby, upon detachment of the support mechanism from the motor casing, the bit driver member and the bit are locked in a predetermined indexed or rotationally oriented position relative to the housing. The bit driver member includes a spring disposed in a bore formed therein and engageable with a coupling part for permitting axial excursion of the bit to accommodate the axial space occupied by successive helical convolutions of conductor wire as a coiled connection is formed.

14 Claims, 5 Drawing Figures

BIT DRIVING ATTACHMENT FOR CONDUCTOR WRAPPING TOOL

BACKGROUND OF THE INVENTION

1. Field of the Invention

The present-invention pertains to a rotary bit driving and backforce accommodating assembly configured as an attachment for an electrical conductor wrapping tool.

2. Background

In the art of conductor wrapping tools wherein flexible electrical conductor wires are coiled in a series of helical convolutions about a terminal pin by a rotary bit it is desirable to provide an arrangement wherein the bit is allowed to undergo axial excursion away from the wire coils as the successive helical convolutions are formed to prevent excessive coiling forces and to actually physically accommodate the growth in axial length of the coil. In this regard it has been proposed as described, for example, in U.S. Pat. No. 3,480,119 to provide bit driving structure wherein a bit driver member is mounted for axial movement with the bit away from the wire coil as it is being formed against the urging of a spring member or the like wherein the bit is constantly urged in the working position but is allowed to undergo axial excursion relative to the driving tool. In this way the operator does not have to accommodate the growth in axial length of the wire coil during the coiling process.

One problem associated with prior art types of conductor coiling or wrapping tools is that the sizing of the spring for urging the bit in the working position may be suitable for one particular wire gauge or size but is then often unsuitable for larger or smaller wire sizes or for connections having a large number of helical convolutions. Prior art practice to overcome this problem has resulted in the need to provide several different tools at the operator work station for use with the specific sizes of conductor wires being coiled by the operator. The provision of plural tools has been necessitated by prior art designs in view of the fact that access to the tool working parts to interchange springs which provide the backforce counteracting force is difficult. However, it is important that a conductor wrapping tool of the general type described herein be provided with means for use with various wire sizes which will accommodate the backforce exerted on the conductor wrapping bit to prevent damage to the wire coils or the bit camming face for a relatively wide range of wire sizes. In this regard the present invention has been developed with a view to overcoming the deficiencies of prior art conductor wrapping tools.

SUMMARY OF THE INVENTION

The present invention provides an improved mechanism comprising a removable attachment for a motor driven conductor wrapping tool which provides a rotary bit driving and support structure and also provides a biasing force exerted axially on the bit to permit axial excursion of the bit relative to the tool as the number of wire coils increases during a conductor wrapping or coiling operation.

In accordance with an important aspect of the present invention there is provided a rotary bit driving and support mechanism configured as an attachment for a motor driven tool wherein a plurality of similar attachments may be selectively interchanged one for the other to accommodate a particular wire size or gauge being wrapped. The axial biasing force acting on the bit urging it in opposition to the axial movement encountered by the bit as a result of forming successive coils of wire on a terminal pin may thus be adapted to the particular wire size being coiled or wrapped.

In accordance with another aspect of the present invention there is provided a rotary conductor coiling or wrapping bit driving and support attachment which may be readily and conveniently attached to or detached from a tool body or motor casing and placed in driving engagement with or disengaged from a drive shaft.

In accordance with yet another aspect of the present invention a conductor wrapping bit driving and support attachment for a motor driven tool is provided wherein the attachment includes a rotary bit driving member which may be secured in a predetermined rotative position before the attachment is removed from the tool and disconnected from the motor drive shaft. Accordingly, upon reassembly of the attachment to the tool the bit is in a predetermined rotative position relative to the drive shaft and relative to a sleeve member in which the bit is disposed.

The bit driving and support attachment advantageously includes a twist and lock type connection to the tool housing which includes means for locking the bit in a predetermined position relative to the attachment housing before the attachment is removed from the tool body.

Those skilled in the art will recognize the above described features and advantages of the present invention together with other superior aspects thereof upon reading the detailed description which follows in conjunction with the drawing.

DESCRIPTION OF A PREFERRED EMBODIMENT

Figure 1:
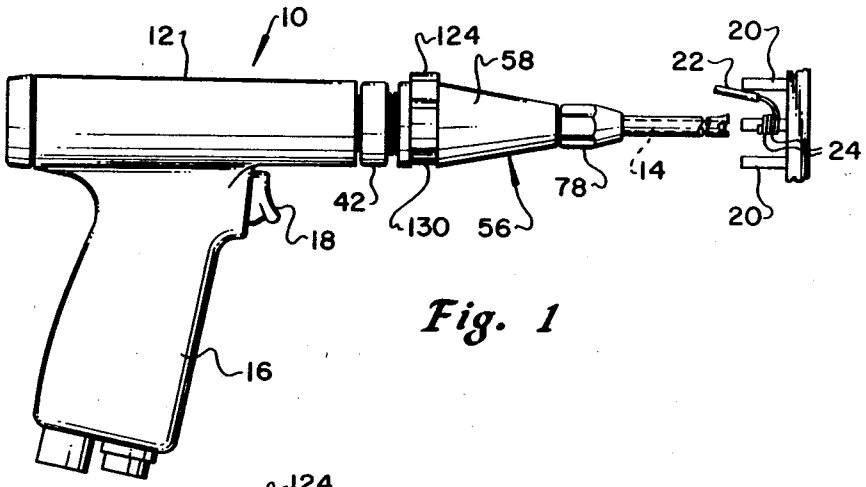
FIG. 1 is a side elevation of a conductor wrapping tool including the improved detachable bit driving and support mechanism of the present invention.

In the description which follows like parts are marked throughout the specification and drawing with the same reference numerals, respectively.

Figure 2:
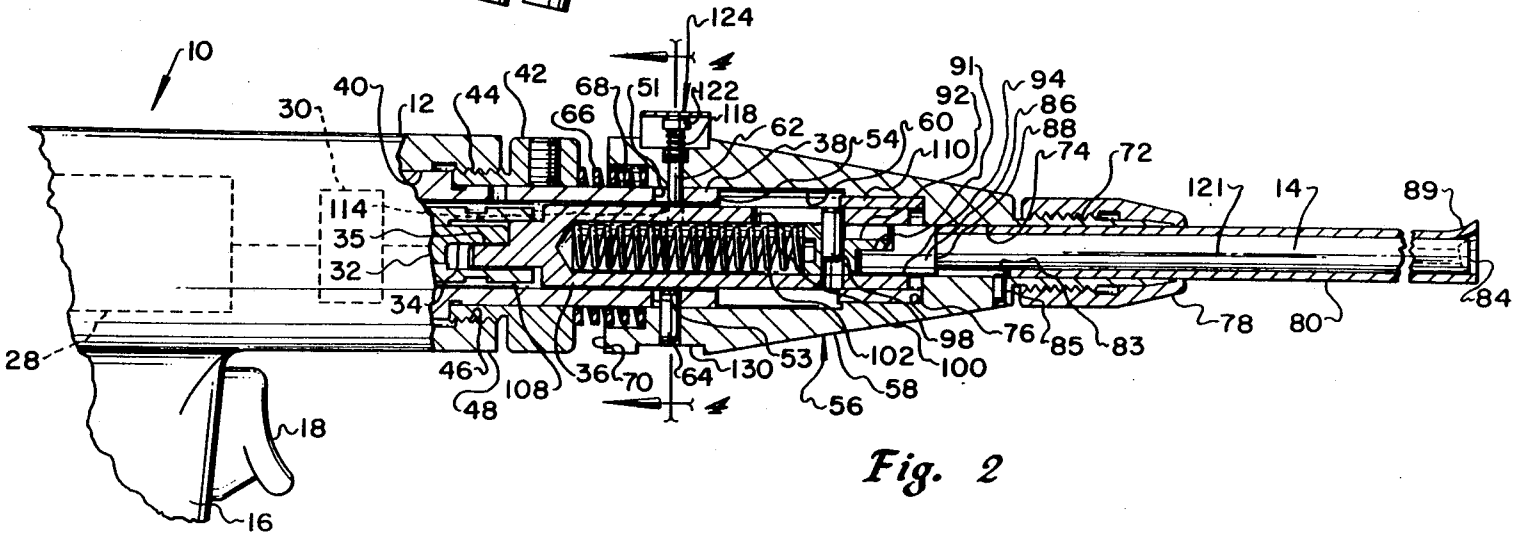
FIG. 2 is a side view in section of the improved bit driving and support mechanism.

Referring to FIGS. 1 and 2, there is illustrated a portable hand held conductor wrapping tool, generally designated by the numeral 10. The tool 10 includes a body forming a motor casing 12 in which a fluid or electrically energized motor, not shown in FIG. 1, is disposed and is operative to rotatably drive a conductor wrapping bit 14. The casing 12 includes a depending hand grip portion 16 and a motor actuating trigger 18. The tool 10 is operative to form electrical connections between one or more terminal pins 20, FIG. 1, and a flexible electrical conductor 22 by coiling the conductor in a series of helical, axially spaced, side by side convolutions 24 which are tightly coiled on the terminal pin 20 by the bit 14 in a known manner.

As the bit 14 coils successive convolutions 24 onto the pin 20 at least the bit 14 must move axially relative to the pin 20 to accommodate the growth in successive numbers of wire convolutions as they are formed. Since the operator is normally unable to feel the very slight amount of axial force exerted on the bit as it is forced axially away from the pin 20 it has been proposed to support the bit within the tool in such a way that the bit undergoes axial excursion under a resilient biasing force such as provided by a coil spring or the like to constantly urge the bit into contact with the conductor during the coiling operation but to accommodate axial excursion of the bit during the coiling operation. An example of a prior art type conductor coiling bit supporting and driving apparatus is described in U.S. Pat. No. 3,480,119 issued to W. J. Baker et al and assigned to the assignee of the present invention. However, as mentioned previously, the provision of a helical coil spring or other elastically deflectable means disposed within the motor housing 12 and of a particular predetermined spring rate is rather limiting as regards the utilization of a particular tool.

Accordingly, the present invention provides for an improved conductor wrapping bit driving and support mechanism which is configured as a quickly releasable attachment to the tool motor housing and operable to be in drivable engagement with the tool motor and whereby the attachment may be provided with means to yieldably urge the bit into engagement with the conductor wire. For example, it has been determined in accordance with the present invention that a mechanism providing an axial biasing force exerted on a bit for wrapping 24 gauge electrical conductor wire could have a preload of approximately 30 ounces of axial biasing force urging the bit in its working position, which biasing force may progress to a total of 40 ounces over an axial range of travel of approximately 0.250 inches during the wire coiling operation. In like manner a similar attachment for wrapping 26 gauge conductor wire can be provided with biasing means adapted to exert an axial biasing force ranging from only 20 to 26 ounces over 0.250 inches axial travel of the bit. Still further an attachment of the type described herein in accordance with the present invention for wrapping 30 gauge electrical conductor wire can be provided to have an axial biasing force range of from about 15 ounces to 19 ounces over the same axial displacement of the bit of about 0.250 inches. Accordingly, an operator may be provided with a tool having a motor casing 12 and a plurality of separate conductor wrapping bit assemblies and bit driving and support mechanisms which meet the desired bit backforce ranges, respectively.

Figure 3:
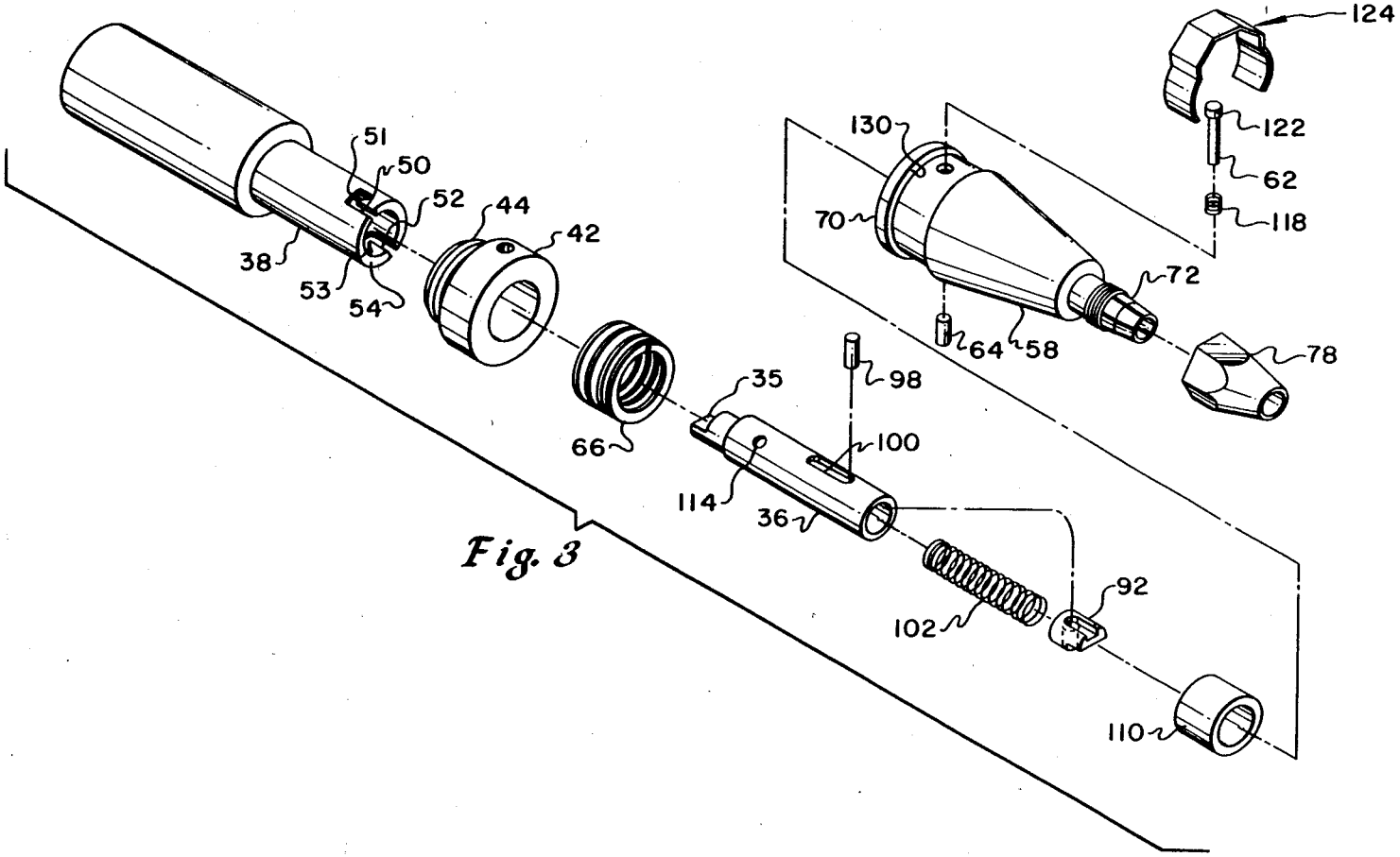
FIG. 3 is an exploded perspective view of the parts of the bit driving and support mechanism.

Referring now to FIGS. 2 and 3, with regard to certain parts of the bit driving and support mechanism, the motor casing 12 is adapted to support a suitable bit driving motor 28 which is drivably connected to a bit position stop or index mechanism generally designated by the numeral 30. A detailed description of the mechanism 30 is not believed to be necessary to a complete understanding of the present invention and reference to U.S. Pat. No. 3,480,119 may be had for a detailed description of a suitable position stop mechanism. The motor 28 is drivably connected to a drive shaft 32 through the position mechanism 30 whereby the drive shaft 32 is also operable to be rotationally stopped in a predetermined rotative position. The drive shaft 32 includes a suitable drive flat 34 which is drivably engaged with a cooperating drive flat 35 formed on a rotary bit driver member 36.

The bit driver member 36 is disposed within an elongated sleeve member 38 which extends into a bore 40 formed in the casing 12 and is supported therein and retained in assembly with the casing by a collar 42. The collar 42 is provided with an axially projecting portion having external threads 44 formed thereon and threadedly engageable with cooperating threads 46 formed on a front end portion 48 of the casing 12. As shown in FIG. 3, the sleeve member 38 is provided with a pair of opposed somewhat "j" shaped slots 50 and 52 having respective parallel leg portions which open toward the end face 54 of the sleeve member 38.

The sleeve member 38 is adapted to support and lock with respect to the casing 12 a bit driving and support mechanism configured as a removable attachment and generally designated by the numeral 56. The bit driving and support mechanism 56 includes a somewhat conically shaped housing member 58 having a generally cylindrical bore 60 for receiving the forward portion of the sleeve 38. A pair of radially projecting pins 62 and 64 are supported by the housing 58 and are adapted to project into the "j" shaped slots 50 and 52, respectively, for securing the housing 58 to the sleeve 38. A coil spring 66 is adapted to be interposed between the collar 42 and a recess or counterbore 68 formed in an end face 70 of the housing 58 for biasing the pins into short leg portions 51 and 53 of the "j" slots 50 and 52, respectively.

The housing 58 also includes a distal end portion forming a threaded collet 72. A reduced diameter bore 74 extends through the collet 72 and intersects an intermediate bore 76 between the bores 60 and 74. The collet 72 is adapted to receive a nut 78 whereby the collet is radially deflectable to retain an elongated tubular sleeve 80 in the bore 74. The sleeve 80 is adapted to journal the rotary conductor wrapping bit 14 in a known manner. The bit 14 includes a distal end face 84 having suitable surfaces thereon for engaging and forming the helical convolutions 24 of the coiled wire portion disposed on the pin 20. The bit 14 also includes an enlarged diameter drive tang 86 forming a shoulder 88 engageable with the sleeve 80 to retain the bit within the sleeve. The sleeve 80 includes a longitudinally extending slot 83 which is in registration with a locating pin 85 disposed in the housing 58 for orienting the sleeve relative to the housing so that a conductor receiving portion such as a conductor wire receiving funnel 89, FIG. 2, is properly oriented with respect to the bit and the bit indexing mechanism 30 when the bit driving and support attachment 56 is secured to the housing 12.

The bit 14 includes a driving flat 91 formed on the drive tang 86 which is in driving engagement with a cooperating drive member 92 disposed in a bore 94 formed in the bit driver 36. The drive member 92 is secured for rotation with the bit driver 36 by a radially projecting pin 98 which is secured to the drive member and projects into a longitudinally extending slot 100 formed in the bit driver. A coil spring 102 is disposed in the bore 94 and is operable to bias the drive member 92 into the position illustrated in FIG. 2. However, in response to an axially directed force exerted on the end face 84 of the bit 14, urging the bit into the bore 94, the drive member 92 is operable to move against the biasing force of the spring 102 toward the end of the slot 100 opposite that which is engaged by the pin 98 as illustrated in FIG. 2. The spring 102 is provided with a force-deflection characteristic which exhibits a relatively slight change in the biasing force acting on the drive member 92 and the bit 14 when the bit is urged axially toward the closed end of the bore 94 by the formation of successive convolutions of coiled wire as a wire termination is formed.

Figure 4:
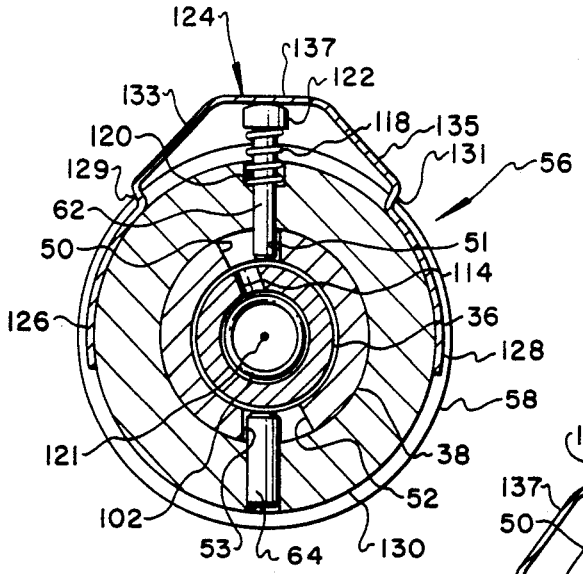
FIG. 4 is a section view taken from the Line 4—4 of FIG. 2.

Referring now primarily to FIGS. 2 and 4, the bit driver 36 is journalled for rotation in suitable bearing means 108 disposed in the housing 12 and a journal bearing 110 disposed in the bore 76. The rotative position of the bit driver 36 must be predetermined if the attachment 56 is removed from the tool housing 12 so that, upon reassembly, the drive flats 34 and 35 may be in registration with each other and the bit 14 oriented in its correct rotative position for performing a conductor coiling operation. In this regard the bit driver 36 is provided with a radially projecting opening 114, FIGS. 4 and 5, of a suitable diameter for receiving the radially inward distal end of the pin 62. The pin 62 is journalled in the housing 58 for radial sliding movement relative to the axis of rotation 121 of the bit 14 and is biased in the position shown in FIG. 2 by a coil spring 118 which is retained in a counterbore 120. The spring 118 is also engageable with an enlarged head portion 122 of the pin 62. The opening 114 is aligned with the "j" slot 50 such that in the arrested or indexed position of the bit driver member 36 the pin 62 may be radially inwardly displaced into the opening after the housing 58 has been rotated from the position shown in FIG. 4 to the position shown in FIG. 5 with respect to the bit driver 36.

Figure 5:
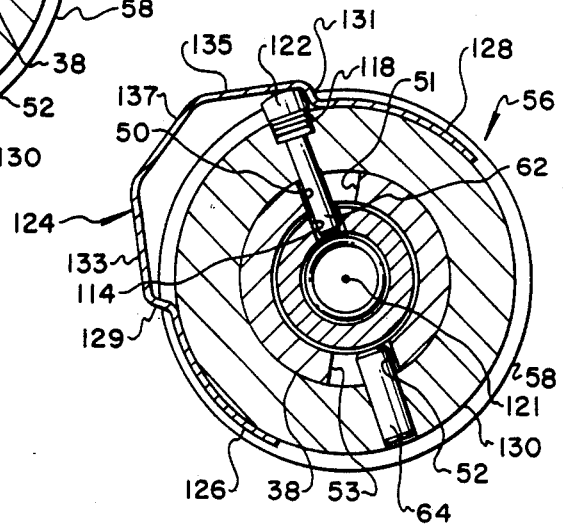
FIG. 5 is a section view taken from the same line as the view of FIG. 4 showing the bit driving and support mechanism in a position to be removed from the tool motor housing.

The pin 62 is maintained in the positions shown in FIGS. 2, 4 and 5 by an actuator member comprising a somewhat arcuate shaped band formed of elastically deflectable metal or plastic, for example, and generally designated by the numeral 124. The actuator 124 includes opposed somewhat arcuate portions 126 and 128 which are disposed in a circumferential groove or recess 130 formed in the housing 58. The actuator 124 also includes opposed inclined cam surfaces 133 and 135 which are joined to the arcuate portions 126 and 128 by integral legs 129 and 131 and also extend toward a further radially outwardly disposed crown portion 137.

In the position illustrated in FIG. 4 the pin 62 is urged radially outwardly into engagement with the crown portion 137 so that the radially inward end of the pin 62 is clear of the bit driver 36. The opening 114 is located with respect to the drive flat 35 in a position such that when the bit driver 36 is in its at rest and indexed position, as determined by the positioning mechanism 30, the pin 62 is not aligned with the opening 114. Upon rotation of the actuator 124 in the groove 130, the cam surface 135 urges the pin 62 radially inward.

However, since the pin 62 is not aligned with the opening 114 continued turning effort on the actuator 124 will cause the housing 58 to rotate to the position shown in FIG. 5 wherein the pins 62 and 64 are aligned with the longitudinal leg portions of the "j" slots 50 and 52. As the housing 58 moves to the FIG. 5 position the inward urging force acting on pin 62 by the actuator 124 will force the pin into the opening 114 locking the bit driver 36 in a predetermined position with respect to the housing 58. The final position of the actuator 124 is illustrated in FIG. 5 which is the position wherein the housing 58 may be moved longitudinally relative to the sleeve 38 out of the slots 50 and 52 and away from the housing 12 to remove the attachment 56 from the tool 10. A similar attachment, not shown, having a different bit configuration, if desired, and, in particular, a backforce spring of a different force deflection characteristic in accordance with the particular size of wire or coiled connection to be formed by the tool 10, may then be connected to the casing 12.

When it is desired to mount the mechanism or attachment 56 on a tool 10 the arrangement of the pin 62 and the member 124 will be such that the pin will be in locking registration with the bit driver 36 to prevent rotation of same relative to the housing 58. When the attachment 56 is to be attached to the housing 12 the pins 62 and 64 are aligned with the "j" slots 50 and 52 and the housing 58 is pushed axially over the sleeve 38. The bit driver 36 is locked in a predetermined position relative to the housing 58, and the housing 58 may be oriented relative to the sleeve 38 due to the pins 62 and 64 and the "j" slots 50 and 52. Since the drive shaft 32 is oriented in a predetermined position relative to the sleeve 38 the drive surfaces 34 and 35 will move into registration with each other as the attachment 56 is pushed axially onto the sleeve 38 and toward the collar 42. When the pins 62 and 64 bottom in the "j" slots 50 and 52 the actuator 124 is then rotated to a position whereby the pin 62 may move radially outward into engagement with the crown 137 and thereby be removed from the opening 114. The housing 58 is then rotated until the pins 62 and 64 move into the respective slot leg portions 51 and 53. The tool 10 is now ready for conventional operation to form a coiled wire connection.

It will be appreciated from the foregoing description that a conductor wrapping tool such as the tool 10 may be used in conjunction with a plurality of bit driving and supporting mechanisms such as the mechanism or attachment 56 whereby a predetermined bit configuration and/or biasing spring 102 may be used in conjunction with the particular wire gauge or number of coiled convolutions being formed. Moreover, in accordance with the present invention a conductor wrapping bit attachment is provided which is quickly detachable from the tool motor housing whereby the rotary wrapping bit is locked in a predetermined rotative position. such that upon reassembly to the tool the bit is properly rotatably positioned for performing a conductor coiling operation.

The various components of the attachment 56 described herein may be formed using conventional engineering materials such as relatively free machining plastics or metals. The bit 14 is typically formed in accordance with the teaching of U.S. Pat. Nos. 3,531,056; 3,625,262 and 3,781,932, for example, all of which are assigned to the assignee of the present invention.

Although a preferred embodiment of the invention has been described herein in detail those skilled in the art will recognize that various substitutions and modifications may be made to the specific embodiment described without departing from the scope and spirit of the appended claims.

What we claim is:

1. A conductor wrapping bit driving and support mechanism for use in a conductor wrapping tool, said tool having a motor casing including a motor, a bit indexing means for arresting rotation of said bit in a predetermined rotative position, drive shaft means and support means for said mechanism, said mechanism including;

a housing including means adapted to be engaged with said support means on said tool for connecting said mechanism to said tool, said housing including means for supporting a rotatable conductor wrapping bit;

a bit driver member interconnecting said drive shaft means and said bit; and locking means associated with said housing for locking said bit driver member in a predetermined rotative position relative to said housing so that said housing may be removed from said tool and reconnected to said tool.

2. The mechanism set forth in claim 1, wherein:

said locking means includes a pin disposed on said housing for movement into locking engagement with cooperating means on said bit drive member, and means for holding said pin in locking engagement with said bit driver member.

3. The mechanism set forth in claim 2, wherein:

said means for holding said pin in locking engagement with said bit driver member comprises a member disposed on said housing and engageable with said pin, said member including a cam surface movable relative to said housing between a first position permitting said pin to move to a position to disengage said bit driver member and a second position to force said pin into locking engagement with said bit driver member.

4. The mechanism set forth in claim 3, wherein:

said member for moving said pin comprises a generally arcuate shaped band disposed on and rotatable relative to said housing.

5. The mechanism set forth in claim 2, wherein:

said support means on said tool comprises a support sleeve adapted to extend into a bore formed in said housing, said sleeve including "j" slot means opening to a distal end of said sleeve for receiving said pin whereby said housing may be disposed on said tool and locked in engagement with said sleeve by said pin.

6. The mechanism set forth in claim 5, including:

a second pin disposed on said housing and spaced apart radially from the first mentioned pin with respect to the axis of rotation of said bit and engageable with "j" slot means on said sleeve.

7. The mechanism set forth in claim 5, including spring means interposed between said housing and said tool for urging said housing into locked engagement with said sleeve.

8. A conductor wrapping bit driving and support mechanism for use in a conductor wrapping tool, said tool having a motor casing including a motor, a bit indexing means for arresting rotation of said bit in a predetermined rotative position, drive shaft means, and support means for said mechanism, said mechanism including;

a housing including means adapted to be engaged with said support means on said tool for connecting said mechanism to said tool, said housing including means for supporting a rotatable conductor wrapping bit;

a bit driver member interconnecting said drive shaft means and said bit, said driver member including a coupling portion and means for yieldably biasing said coupling portion to urge said bit in a first position and to permit axial excursion of said bit and said coupling portion relative to said driver member during the formation of successive helical convolutions of a conductor by said bit; and means associated with said housing for locking said bit driver member in a predetermined rotative position relative to said housing so that said housing may be removed from said tool and reconnected to said tool without rotating said driver member and said bit with respect to said housing.

9. The mechanism set forth in claim 8, wherein:

said locking means includes pin means disposed on said housing for radial movement with respect to the axis of rotation of said bit into locking engagement with cooperating means on said driver member, and means for holding said pin means in locking engagement with said driver member.

10. The mechanism set forth in claim 9, wherein:

said means for holding said pin means comprises a member disposed on said housing and engageable with said pin means, said member being rotatable relative to said housing between a first position permitting said pin means to move to a position to disengage said driver member and a second position to force said pin means into locking engagement with said driver member.

11. The mechanism set forth in claim 9, including:

"j" slot means formed on said tool for receiving said pin means whereby said housing may be disposed on said tool and locked in engagement therewith by said pin means.

12. A support mechanism for supporting a rotatable conductor wrapping bit in driving connection with a motor of a conductor wrapping tool, said tool comprising a motor casing having a motor disposed therein, indexing means and drive means drivably connected to said motor through said indexing means for arresting the rotation of said drive means in a predetermined rotative position thereof, said motor casing including a support portion at a forward part of said motor casing, said support portion being adapted to releasably support said mechanism on said tool, said mechanism including;

a housing including means for supporting a rotatable wrapping bit on said housing;

a rotatable bit driver member operable to drivably interconnect said drive means with said bit; and means on said housing including a locking member for forming locking engagement between said housing and said support portion for retaining said mechanism in engagement with said motor casing, said member being operable to engage said bit driver member to prevent rotation of said bit driver member relative to said housing when said mechanism is disengaged from said motor casing.

13. The mechanism set forth in claim 12, including:

means operable to move said locking member from a first position disengaged from said bit driver member to a second position in locking engagement with said bit driver member.

14. A releasable support mechanism for supporting a rotatable conductor wrapping bit in driving connection with a motor of a conductor wrapping tool, said tool comprising a motor casing having a motor disposed therein, an indexing mechanism and drive shaft means drivably connected to said motor through said indexing mechanism for arresting the rotation of said drive shaft means in a predetermined rotative position thereof, said motor casing including a support sleeve portion extending from a forward part of said motor casing, said support sleeve portion including a distal end having axially extending slot means formed therein and said drive shaft means including means forming a drive connection, said support mechanism including;

a housing including means for supporting a rotatable wrapping bit on said housing and means for supporting a generally tubular sleeve disposed in surrounding relationship to said bit;

bearing means in said housing for rotatably supporting a rotatable bit driver member operable to drivably interconnect said drive shaft means with said bit, said bit driver member including means for yieldably urging said bit in one axial direction and operable to permit said bit to move axially in the opposite axial direction in response to engaging successive helical convolutions of conductor wire; and means on said housing for forming locking engagement between said housing and said support sleeve portion for retaining said support mechanism in engagement with said motor casing, said locking means including a member operable to engage said driver member to prevent rotation of said driver member relative to said housing when said support mechanism is disengaged from said motor casing.

* * * * *